United States Patent [19]

Parsons

[11] 4,107,956

[45] Aug. 22, 1978

[54] NARROW FABRICS

[75] Inventor: John T. Parsons, Harrogate, England

[73] Assignee: Lightning Fasteners Limited, Wolverhampton, United Kingdom

[21] Appl. No.: 631,605

[22] Filed: Nov. 13, 1975

Related U.S. Application Data

[63] Continuation of Ser. No. 433,563, Jan. 15, 1974, abandoned, which is a continuation-in-part of Ser. No. 191,777, Oct. 22, 1971, abandoned, which is a continuation of Ser. No. 9,960, Feb. 9, 1970, abandoned.

[30] Foreign Application Priority Data

Feb. 11, 1969 [GB] United Kingdom ..... 7385/69

[51] Int. Cl.[2] ..... D04B 21/00

[52] U.S. Cl. ..... 66/195

[58] Field of Search ..... 66/190, 192, 193, 195

[56] References Cited

U.S. PATENT DOCUMENTS

| | | | |
|---|---|---|---|
| 2,652,705 | 9/1953 | Weinberg | 66/193 |
| 3,222,893 | 12/1965 | Busch et al. | 66/192 |
| 3,453,844 | 7/1969 | Heij | 66/192 |

FOREIGN PATENT DOCUMENTS

| | | | |
|---|---|---|---|
| 6,513,284 | 4/1966 | Netherlands | 66/193 |
| 379,054 | 8/1964 | Switzerland | 66/193 |

*Primary Examiner*—Ronald Feldbaum

*Attorney, Agent, or Firm*—Cushman, Darby & Cushman

[57] ABSTRACT

A method for warp knitting a narrow clasp fastener carrier tape having a strong selvage. A three guide bar construction is employed in which the front guide bar knits a pillar stitch and the middle guide bar performs shogging and lapping movements over two or more needles, with the back bar "laying-in" over three or more needles.

2 Claims, 1 Drawing Figure

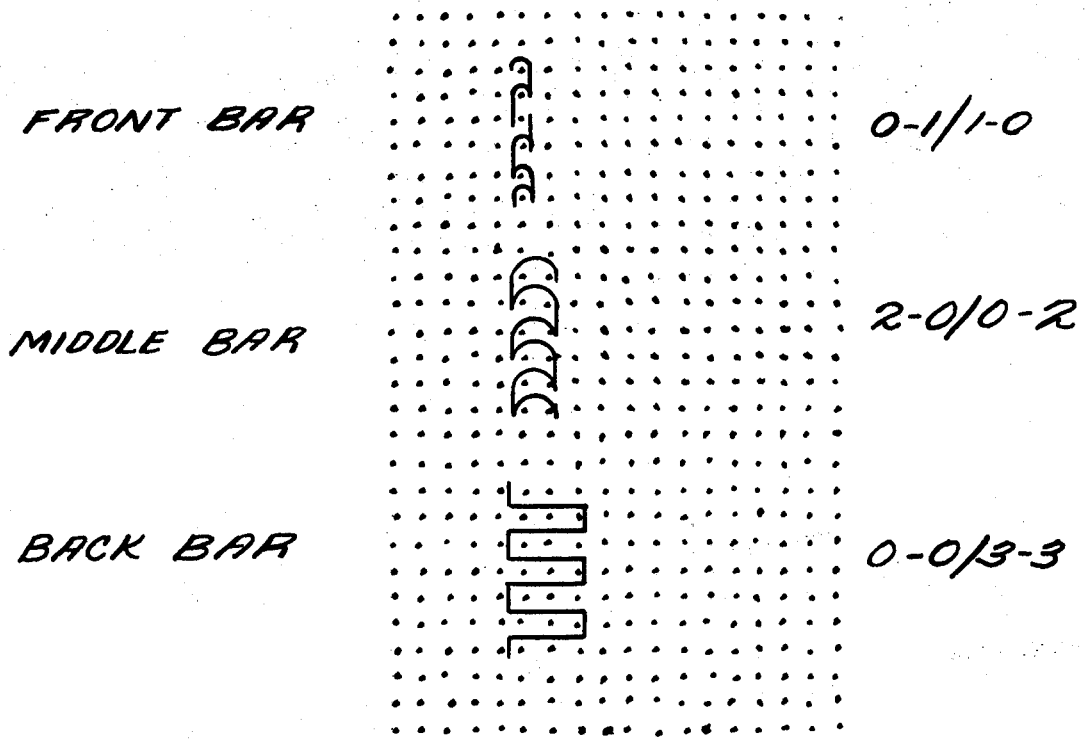
FRONT BAR
0-1/1-0
MIDDLE BAR
2-0/0-2
BACK BAR
0-0/3-3

NARROW FABRICS

This application is a continuation of abandoned application Ser. No. 433,563 filed Jan. 15, 1974 which is a continuation-in-part of abandoned application Ser. No. 191,777 filed Oct. 22, 1971 which in turn is a continuation of abandoned application Ser. No. 9,960 filed Feb. 9, 1970.

The present invention relates to narrow fabrics or tapes and more particularly to such fabrics or tapes suitable for use in conjunction with sliding clasp fasteners.

By "narrow fabric" or "tape" is meant a fabric not exceeding 4 inches in full and finished width.

Hitherto, narrow fabrics or tapes suitable for use as carrier or support structures for sliding clasp fasteners have been formed by traditional weaving techniques from both cotton and nylon yarns; and tapes prepared in this manner have in practice been found to possess sufficient strength and stability, i.e. a resistance to longitudinal and lateral stretch and a tendency to take up a tubular form instead of remaining flat under longitudinal tension, particularly in the selvedges to meet necessary performance requirements.

Furthermore, such tapes derived from nylon yarns haves possessed the additional useful properties of superior abrasion and shrinkage resistance and the ability to "drip-dry".

However, the fabrication of tapes by weaving is a relatively slow method of production by present day standards and attention has thus been directed to the possibility of warp knitting such tapes. In practice, though, warp knitting tapes using conventional knitting constructions so far has been thwarted by a corresponding reduction in the important properties of selvedge strength and stability.

Thus, a synthetic fibre warp knitted narrow fabric possessing sufficient selvedge strength and stability such that it may be satisfactorily employed as a sliding clasp fastener carrier tape would be of immediate value and benefit to the art.

Accordingly, the present invention provides a method for warp knitting a narrow fabric or tape as hereinbefore defined in which in a three guide bar construction the front guide bar knits a pillar stitch, the middle guide bar performs a two needle overlap in successive courses and the back guide bar lays in over three or more needles.

Preferably, the knitting yarns are not more than 70 denier.

The present invention further provides a warp knitted tape which possesses adequate selvedge strength and stability for employment as a sliding clasp fastener support tape.

Thus, the constructions of the present invention enable a plurality of narrow fabrics or tapes of required width to be produced side-by-side simultaneously on a single knitting machine. Each separate tape or fabric possessing improved stability and selvedge strength.

The construction may also be modified slightly as it is apparent to those skilled in the art to enable laid-in yarns to be included in order to effect a strong edge, which may take the form of a "bead" effect at either or both selvedges if required.

The process of the invention is of course in no way limited to tapes made from nylon yarns and is equally applicable to the production of tapes comprising yarns of blends thereof derived from other synthetic polymers, for example, polyacrylics, polyesters and polyolefins and such materials as glass.

Synthetic fibre blends with cotton or other natural fibres are also included.

It is to be understood that the expression "yarn" includes both staple fibre and continuous mono-or multi-filament yarns.

Yarns that may be mentioned which are of particular value in the practice of the present invention include those derived from polyhexame thylene adipamide, polyethylene terephthalate, polypropylene and glass.

The drawing is a point diagram of a warp-knitted tape made with a three guide bar construction as follows:

| | | |
|---|---|---|
| Yarn Front bar | 30 denier, 10 filament yarn derived from polyhexamethylene adipamide. | |
| Middle bar<br>Back bar | 40 denier, 13 filament yarn derived from polyhexamethylene adipamide | |
| Pattern notation | Front bar | - 0–1/1–0 |
| | Middle bar | - 2–0/0–2 |
| | Back bar | - 0–0/3–3 |
| Run-in | Front bar | - 39.0 in/rack |
| | Middle bar | - 87.5 in/rack |
| | Back bar | - 53.5 in/rack |
| Knitted courses | | - 58/in |
| Machine gauge | | - 28 |

Tapes knitted according to this construction were found to possess adequate selvedge strength and stability for use as sliding clasp fastener support tapes.

Though the above example is directed specifically to the fabrication of tapes from yarns derived from polyhexamethylene adipamide, simple modification of such knitting constructions as would be clear to those skilled in the art will render them equally applicable to the fabrication of tapes from other yarns, e.g. those derived from polyethylene terephthalate.

Besides the end-uses with which the present invention is concerned, the knitting constructions described above may be employed for the fabrication of ribbons where the characteristics imported by those constructions may be required.

What is claimed is:

1. A method for warp knitting a stable sliding clasp fastener carrier tape with a strong selvage resistant to longitudinal and lateral stretch not exceeding 4 inches in full and finished width employing three guide bars in which the front guide bar knits a pillar stitch, the middle guide bar performs a two needle overlap in successive courses and the back guide bar "lays-in" over three or more needles.

2. A method as in claim 1 in which reinforcing of one selvage is performed by laying in yarns.

* * * * *